United States Patent [19]

Card et al.

[11] 3,978,800

[45] Sept. 7, 1976

[54] NEEDLE BAR FOOT CONSTRUCTION FOR MULTIPLE NEEDLE SKIP-STITCH TUFTING MACHINE

[75] Inventors: Roy T. Card, Rodney E. Hill, both of Chattanooga, Tenn.

[73] Assignee: Card & Co., Inc., Chattanooga, Tenn.

[22] Filed: Aug. 15, 1975

[21] Appl. No.: 604,903

[52] U.S. Cl. ..... 112/79 R; 112/221

[51] Int. Cl.[2] ..... D05C 11/06; D05B 55/16

[58] Field of Search ..... 112/79 R, 79 A, 221, 112/78

[56] References Cited

UNITED STATES PATENTS

| | | | |
|---|---|---|---|
| 2,989,014 | 6/1961 | Dedmon | 112/79 R |
| 2,991,738 | 7/1961 | Zenner et al. | 112/79 A |
| 3,016,029 | 1/1962 | Card | 112/79 A |
| 3,259,089 | 7/1966 | Rockholt | 112/221 X |

*Primary Examiner*—H. Hampton Hunter

*Attorney, Agent, or Firm*—Harrington A. Lackey

[57] ABSTRACT

A multiple needle skip-stitch tufting machine in which each needle bar is provided with a needle foot member supporting a pair of needles. Each foot member includes a pair of arms, each arm supporting a needle in such a manner that the arms of the foot member of one needle bar interdigitate with the arms of the foot member of an adjacent needle bar to provide a relatively narrow gauge machine in which the skip-stitching is formed in pairs of tufted rows, and a row in one pair may be stitched between an adjacent pair of rows.

9 Claims, 6 Drawing Figures

NEEDLE BAR FOOT CONSTRUCTION FOR MULTIPLE NEEDLE SKIP-STITCH TUFTING MACHINE

BACKGROUND OF THE INVENTION

This invention relates to a tufting machine, and more particularly to a multiple-needle skip-stitch tufting machine.

The art of skip-stitching in the tufting of pile fabrics is well-known, as illustrated in the J. L. Card U.S. Pat. No. 3,016,029, issued Jan. 9, 1962; the Rockholt U.S. Pat. Nos. 3,259,088 and 3,259,089, issued, July 5, 1966; and the Dedmon U.S. Pat. No. 2,989,014, issued June 20, 1961.

SUMMARY OF THE INVENTION

It is an object of this invention to provide a multiple-needle skip-stitch tufting machine incorporating a unique foot construction for needle bars to skip-stitch with overlapping pairs of needles, not only to perfect a more narrow gauge machine, but also to produce novel patterns with the skip-stitching effect, as well as with yarns of different colors carried by the different pairs of needles.

The skip-stitch machine made in accordance with this invention includes a plurality of vertical elongated needle bars. Each needle bar is provided with a latching aperture adapted to be engaged by an operating latch pin slidably received in a continuously vertically reciprocating needle drive member. The latch pins are controlled by solenoids which are selectively energized by a conventional pattern control means. When the latch pins are operative to engage the latching apertures in the needle bars, the needle bars reciprocate as a unit with the drive member for penetrating the base fabric to create tufts of pile yarn carried through the base fabric by the respective needles. When the latch pins are inoperative to disengage the respective needle bars, the needle bars are carried to an elevated position to abut against an adjustable stop member, and are held stationary in this elevated position by spring means connected to the needle bars.

The operative or bottom portion of each needle bar is provided with a foot member of novel construction. Each of a first set of needle bars, which alternate with a second set of needle bars is provided with a first uniform foot member. The first foot member includes a pair of needle-holding arms, one of which projects forward in longitudinal alignment with the first needle bar. The front ends of the arms are connected by a bridge member so that the bridge member and arms form a substantially U-shaped foot member, opening rearward. The proximate or rear end of the unattached needle-holding arm is free.

Each of the second needle bars, or a needle bar in the second set, is provided with a uniformly constructed second foot member of slightly different construction from the first foot member. The second foot member is also U-shaped but opens forward and includes a pair of needle-holding arms, each of which is offset from the vertical longitudinal plane of the second needle bar. One of the arms of the second foot member projects forward into and between the arms of an adjacent first foot member. The rear or proximate ends of the arms of the second foot member are fixed to the second needle bar.

In this manner, the construction of the first and second foot members permit all of the needle bars to be supported in transverse alignment relative to the feeding direction of the base fabric, and also permit transverse alignments of all of the needles, with each first needle being disposed between a pair of second needles. Another way of describing the construction of the foot members is that the needle-holding arms of a first foot member interdigitate with the needle-holding arms of a second foot member.

Each of the foot members may also be provided with a yarn tension guide for each corresponding needle, such as a yarn guide member having a pivoted and tensioned feed dog.

DESCRIPTION OF THE PREFERRED EMBODIMENTS

Figures 1, 6:
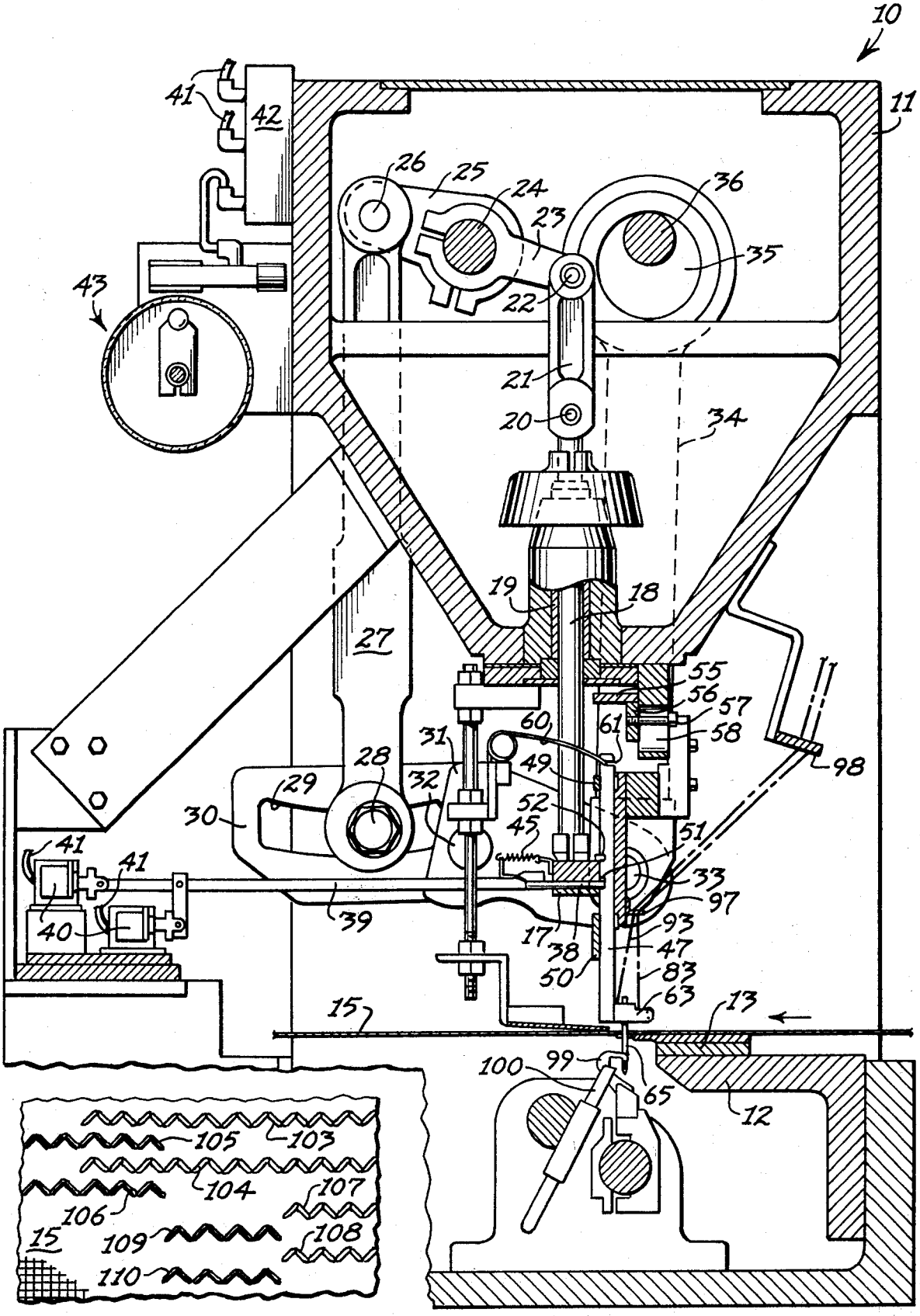
FIG. 1 is a fragmentary sectional elevation of a multiple-needle tufting machine made in accordance with this invention, in which all of the needle bars are latched to the drive member and are in their lowermost position in which the needles are penetrating the base fabric.
FIG. 6 is a fragmentary bottom plan view of the tufted fabric illustrating a representative skip-stitch pattern produced by the tufting machine made in accordance with this invention.

Referring now to the drawings in more detail, FIG. 1 discloses a tufting machine 10 made in accordance with this invention, including a frame or housing 11 having a bed plate 12 upon which is supported a needle plate 13. The needle plate 13 is adapted to support in a substantially horizontal plane, a web or base fabric 15 adapted to be moved, by conventional means, not shown, in the direction of the arrow from front-to-rear through the machine 10.

Extending transversely of the machine 10 above the needle plate 13 is an elongated transverse needle drive member 17. The needle drive member 17 is supported by a plurality of transversely spaced push rods 18, only one of which is shown in the drawings. Such push rod 18 is adapted to vertically reciprocate within the sleeve or bearing 19 in the housing 11. The upper end of the push rod 18 is pivotally connected by pin 20 to the lower end of link arm 21, the upper end of which is pivotally connected by pin 22 to one end of drive lever 23. The other end of the drive lever 23 is fixed to the rock shaft 24. The rock shaft 24 supports a plurality of drive levers 23, there being one drive lever 23 for each push rod 18.

One end of the rock shaft 24 is fixed to a rock lever 25 pivotally connected by pin 26 to the upper end of a long link bar 27. The lower end of link bar 27 terminates in a pin 28 adjustably journaled in an elongated arcuate slot 29 in the arm 30 of a bell crank 31 mounted upon pivot shaft 32. The opposite arm of bell crank 31 is pivotally connected by pin 33 to the lower end of an eccentric arm 34. The upper end of the eccentric arm 34 is journaled about the rotary cam 35 eccentrically fixed to the needle shaft 36 in a manner well known in the art. Thus, as the needle shaft 36 is continuously driven by motive means, not shown, the rock shaft 24 continuously reciprocates the drive levers 23 to move the push rods 18, and, therefore, the needle drive member 17 between a lower, down-stroke position disclosed in FIGS. 1 and 2 and an elevated or up-stroke position.

Slidably mounted for fore-and-aft reciprocal movement in the needle drive member 17 are a plurality of latch pins 38. Each latch pin 38 is pivotally connected by an elongated connecting rod 39 to a corresponding solenoid 40. The solenoids 40 are connected through electrical conduits or leads 41 to a switch control mechanism 42, which in turn is actuated by a pattern control mechanism 43 of the photoelectric type, or any other convenient pattern control mechanism. Each latch pin 38 is biased forward to a latching position by a coil spring 45. When the corresponding solenoid 40 is energized by the pattern control mechanism 43, the latch pin 38 is retracted to its inoperative position.

A plurality of a first set of elongated needle bars 47 and a second set of alternating elongated needle bars 48 are mounted for vertical reciprocal movement within the guides 49 and 50 fixed to the machine frame 11. Each of the needle bars 47 and 48 is provided with a latch aperture 51 adapted to receive the protracted latch pin 38 in operative tufting position, as illustrated in FIG. 1. Spaced above the latch aperture 51 on each of the needle bars 47 and 48 is a lug 52 adapted to fit against the top of the needle drive member 17 when the latch pin 38 engages the latch aperture 51. The latch lug 52 also functions to prevent each of the needle bars 47 and 48 from descending past the needle drive member 17, even when the needle bar 47 or 48 is unlatched. Furthermore, the lug 52 functions as a driven member to be engaged by the upward moving driving member 17 in order to raise the needle bar 47 or 48 to its elevated or upper-limit position.

A stop member or ledge 55 projects rearward from a bracket 56, to which the stop member 55 is fixed, in the upward path of each needle bar 47 and 48 to engage the upper end of the respective needle bar at the upper limit of its stroke. The bracket 56 is secured by a screw member 57 through a vertical elongated slot 58 in a depending vertical frame portion 59. Thus, by unscrewing the screw member 57, the screw member 57, bracket 56 and stop member 55 may be vertically adjusted to the precise vertical position for the stop member 55 to engage the top of each of the needle bars 47 and 48 at the upper limit of its stroke.

Accordingly, when the adjustable pivot pin 28 in the elongated link bar 27 is released and moved along the slot 29 of the bell crank 31, in order to adjust the length of the vertical stroke of the push rod 18 and thereby the needle drive member 17, the stop member 55 may be vertically adjusted to accommodate the upper limit of the stroke of the needle bars 47 and 48 corresponding to the stroke of the drive member 17. Both the adjustment of the stroke of the push rods 18 and the position of the stop member 55 may be executed with a minimum of delay and effort.

Fixed to the machine frame 11 is a spring member 60 extending forward and being looped around and through a notch 61 in the upper end portion of each of the needle bars 47 and 48. The spring member 60 is biased to urge the corresponding needle bar 47 or 48 into its upward position toward and against the stop ledge 55 when that particular needle bar has been unlatched by retraction of the respective latch pin 38. Thus, when the needle bar 47 or 48 is disengaged in its inoperative position, it remains stationary in its elevated position, while the drive member 17 continues to reciprocate, carrying with it only the unlatched latch pins 38, and the latched needle bars.

Each of the first needle bars 47 is provided with a first foot member 63, while each of the second needle bars 48 is provided with a second foot member 64. All of the foot members 63 and 64 are fixed to the lower or operative portions of the respective needle bars 47 and 48 and project in the same longitudinal direction, or forward, of the respective needle bars 47 and 48. The foot members 63 and 64 are best disclosed in FIGS. 2 – 5. The first foot member 63 is adapted to support a pair of first needles 65 and 66, while the second foot member 64 is adapted to support a pair of second needles 67 and 68.

In the preferred form of the invention, the first foot member 63 includes a pair of needle-holding arms 71 and 72, connected at their forward ends by a first bridge member 73. One of the arms 71 is fixed at its proximate end to the needle bar 47 and projects in the same vertical longitudinal plane of the needle bar 47. The proximate end of the second needle arm 72 is free, but it lies in the same vertical longitudinal plane as the adjacent second needle bar 48. As best disclosed in FIG. 4, the first needle arms 71 and 72 and the connecting bridge member 73 form a U-shaped foot member 63 which opens rearward.

The second foot member 64 likewise includes a pair of parallel, spaced apart, second needle-holding arms 75 and 76 connected at their proximate or rear ends by a second connecting member 77. The second connecting member 77 is fixed to the second needle bar 48 so that both second arms 75 and 76 project forward therefrom with the front or forward ends of the arms 75 and 76 being free. Furthermore, the second arms 75 and 76 are each offset transversely on opposite sides of the vertical longitudinal plane containing the second needle bar 48.

Figures 2, 3, 4, 5:
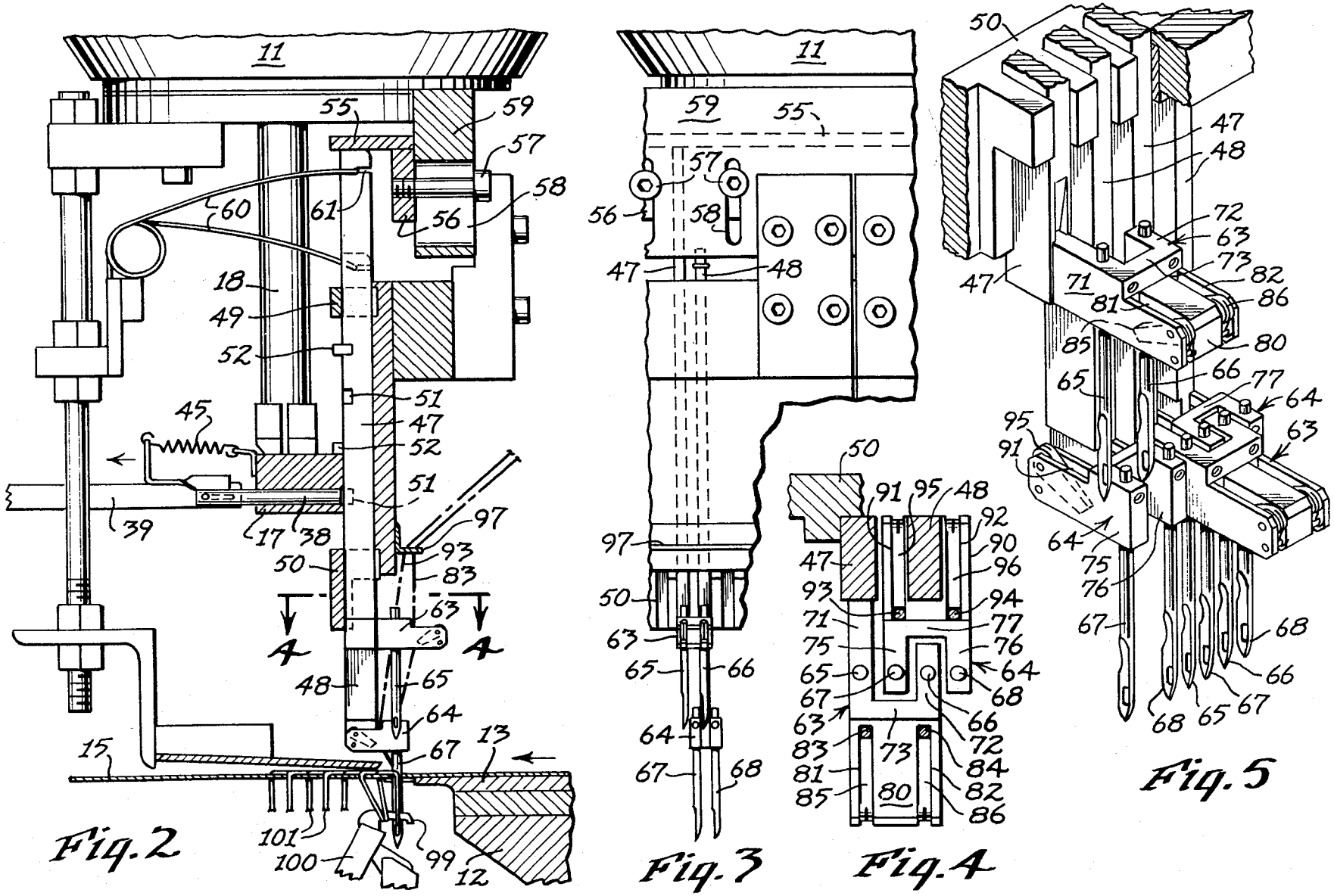
FIG. 2 is an enlarged fragmentary section of a portion of the machine disclosed in FIG. 1, illustrating a first needle bar in its inoperative, unlatched and elevated position, while the second needle bar, immediately behind the first needle bar, is latched in its operative position and in its lowermost position.
FIG. 3 is a fragmentary front elevation of the portion of the machine disclosed in FIG. 2.
FIG. 4 is a section taken along the line 4—4 of FIG. 2.
FIG. 5 is an enlarged, fragmentary, front perspective view of several of the needle bars and foot members, with one of the first needle bars in its inoperative elevated position.

As disclosed in FIG. 4, one of the second arms 75 projects into the space between the arms 71 and 72 of the first foot member 63, while the other second arm 76 projects forward overlapping the other first arm 72. In other words, the respective arms 71, 72, 75 and 76 of the first foot member 63 and the second foot member 64 interdigitate with each other to the extent that the needles 65, 67, 66 and 68 are transversely aligned.

It is also within the scope of this invention for each of the second arms 75 and 76 to be directly attached to the sides of the needle bar 48, thereby eliminating the second bridge member 77.

Fixed to the front of the first bridge member 73 is a yarn tension guide member or block 80 including guide slots 81 and 82 in alignment with the needles 65 and 66, and through which yarns 83 and 84 are adapted to be moved unidirectionally toward the needles 65 and 66 and checked against upward movement by the spring-biased yarn dogs 85 and 86.

In a similar manner, the yarn tension guide member 90 is fixed upon the bridge member 77 and straddles the needle bar 48. The yarn guide member 90 includes yarn guide slots 91 and 92 for unidirectionally guiding yarns 93 and 94 to the needles 67 and 68. The yarns 93 and 94 are checked against upward movement by the spring-biased yarn dogs 95 and 96.

The yarns 83, 84, 93 and 94 are fed to the respective yarn tension guide members 80 and 90 through yarn guides 97 and 98 from a source of yarn supply, not shown.

Adapted to cooperate with the needles 65, 66, 67 and 68 in a conventional manner are loopers, such as the cut pile hooks 99, and cooperating knives 100 for forming cut pile. By substituting loop pile loopers, loop pile may be formed for each penetration of the needles 65 – 68. The cut pile hooks 99 and knives 100 are reciprocably driven in timed relationship with the needle shaft 36, in a conventional manner to form the cut pile 101 (FIG. 2).

In the operation of the machine 10, the needle strokes may be set by adjusting the pivot pin 28 within the slot 29 of the bell crank 31, and the needle bar stop member 55 is correspondingly adjusted by loosening and tightening the screws 57 within the corresponding slots 58.

After the tufting machine 10 is started, the needle shaft 36 rotates continuously to continuously reciprocate the push rods 18, the needle drive member 17 and the respective cut pile hooks 99 and knives 100. However, the stitching of the tuft piles 101 is executed only by those needles 65 – 68 whose needle bars 47 and 48 are latched by the latch pins 38 to the drive member 17. Only the latch pins 38 are latched whose solenoids 40 are de-energized, as selectively determined by the pattern control mechanism 43. In latched position, a needle bar 48, for example, is held securely to the drive member 17 by the protracted latch pin 38 engaging the corresponding latch aperture 51 and the lug 52 engaging the top of the drive member 17, as disclosed in FIG. 2.

However, when the pattern control mechanism 43 energizes a particular solenoid 40 to retract the latch pin 38, the needle bar, such as 47 in FIG. 1, and its corresponding needles 65 and 66 are no longer controlled by the drive member 17. The unlatched needle bar 48 is urged upward by its corresponding spring member 60, and also by the drive member 17 forcing the latch lug 52 upward until the upper end of the needle bar 47 engages the stop ledge 55, where the needle bar 47 is held in its elevated inoperative position by the spring member 60, as disclosed in FIG. 2. When the latch pin 38 is again actuated to enter the latch aperture 51, the needle bar 47 is again positively driven by the needle drive member 17.

Thus, when any one of the needle bars 47 or 48 is latched to the needle drive member 17, a pair of continuous longitudinal rows of stitching are formed in the base fabric 15 simultaneously by a single needle bar. If the adjacent needle bar is driven, it simultaneously forms a pair of continuous longitudinal stitches, one of which lies between the pair of stitches formed by the adjacent needle bar.

In FIG. 6, a pair of lines of stitching 103 and 104 are continuously formed by the needle bar 47, while it is latched to the drive member 17. However, for the initial portion of the stitching 103 – 104 extending about half-way across the base fabric section disclosed in FIG. 6, the adjacent needle bar 48 is unlatched and therefore not stitching or skip-stitching. Just before the stitching 103 and 104 terminates, the adjacent needle bar 48 is latched to commence its lines of stitching 105 and 106. After the initial three or four stitches of the rows 105 and 106 are formed, the original or adjacent needle bar 47 is unlatched to form no stitching at the left end of the base fabric section in FIG. 6. In this example, the last portions of the stitching 103 and 104 are formed simultaneously with the initial portions of the stitching 105 and 106 to create a very fine gauge of stitching and therefore a more bulky yarn content within the overlapping areas of the stitching 103, 104, 105 and 106 in the base fabric 15. If the stitches 103 and 104 are of one color and the stitches 105 and 106 are of a different color, the intermingling cut pile tufts can present a striking pattern, particularly when constrasted with the adjacent areas where stitches have been skipped.

In the lower portion of the base fabric 15 of FIG. 6, pairs of stitching 109 and 110 are commenced at the longitudinal position where stitches 107 and 108 have ceased. A variety of patterns of stitching created by the machine 10 are limited only by the numbers and arrangements of the colors of the yarns and the designs of the pattern utilized on the pattern control mechanism 43.

What is claimed is:

1. In a tufting machine for forming skip-stitch, pile yarn patterns in a base fabric, including means supporting a base fabric for longitudinal movement in a feeding plane through said machine, a reciprocable drive member, a plurality of alternating first and second elongated needle bars, each of said needle bars having an operative end portion, means for latching engagement and disengagement of each needle bar to said drive member, and pattern control means for selectively actuating said latch means, the improvement comprising:

a. a first foot member fixed to the operative end portion of each first needle bar, b. a pair of first needles supported in said first foot member for penetrating said base fabric with pile yarns to form a first pair of tufts therein when said first needle bar is latched to said drive member, c. a second foot member fixed to the operative end portion of each said second needle bar, d. a pair of second needles supported in said second foot member for penetrating said base fabric with pile yarns to form a second pair of tufts therein when said second needle bar is latched to said drive member, and e. said second foot member supporting at least one of said second needles in a vertical longitudinal plane between said pair of first needles.

2. The invention according to claim 1 in which said first and second needles alternate so that each first needle is supported between a pair of second needles.

3. The invention according to claim 2 in which said first and second needles are in transverse alignment.

4. The invention according to claim 1 in which said first foot member comprises a pair of first needle-holding arms, said first arms being transversely spaced apart, said second foot member comprising a pair of second needle-holding arms, said second arms being transversely spaced apart so that one of said first arms is received between said pair of second arms and one of said second arms is received between said pair of first arms, each of said first arms supporting a first needle and each of said second arms supporting a second needle.

5. The invention according to claim 4 in which one of said first arms is in the same vertical longitudinal plane as said first needle bar and the other of said first arms is in the same vertical longitudinal plane as an adjacent second needle bar, each of said second arms being disposed in a vertical longitudinal plane offset between said first and second needle bars.

6. The invention according to claim 5 in which each of said first arms and second arms have proximate and remote ends, the proximate end of said one first arm in the same longitudinal plane as said first needle bar being fixed to said first needle bar, a first bridge member connecting the remote ends of said first arms, the proximate end of said other first arm in the same longitudinal plane as said second needle bar being free, and the remote ends of both said second arms being free.

7. The invention according to claim 6 further comprising a second bridge member connecting the proximate ends of both said second arms to said second needle bar.

8. The invention according to claim 6 comprising a first yarn guide member for each first needle fixed to said first bridge member.

9. The invention according to claim 7 comprising a second yarn guide member for each second needle fixed to said second bridge member.

* * * * *